US005221815A

United States Patent [19]

Bostock et al.

[11] Patent Number: 5,221,815

[45] Date of Patent: Jun. 22, 1993

[54] HEAT RECOVERABLE SOLDERING DEVICE

[75] Inventors: Peter A. Bostock, Atherton; David K. Haygood; Kenneth R. Nicholson, both of Cupertino; J. Michael Nordling, Santa Clara; Pravin L. Soni, Union City, all of Calif.

[73] Assignee: Raychem Corporation, Menlo Park, Calif.

[21] Appl. No.: 736,658

[22] Filed: Jul. 26, 1991

[51] Int. Cl.[5] ..... H01R 4/02; H01R 43/02

[52] U.S. Cl. ..... 174/84 R; 29/871; 29/873; 174/84 C; 174/DIG. 8

[58] Field of Search ..... 174/84 R, 84 C, DIG. 8; 29/869, 871, 872, 873

[56] References Cited

U.S. PATENT DOCUMENTS

| | | | |
|---|---|---|---|
| 3,243,211 | 3/1966 | Wetmore | 174/84 R |
| 3,312,772 | 4/1967 | Sherlock | 174/84 R |
| 3,525,799 | 8/1970 | Ellis | 174/84 R |
| 4,282,396 | 8/1981 | Watine et al. | 174/84 R |
| 4,283,596 | 8/1981 | Vidakovits et al. | 174/84 R |
| 4,504,699 | 3/1985 | Dones et al. | 174/84 R |
| 4,722,471 | 2/1988 | Gray et al. | 228/56.3 |

*Primary Examiner*—Morris H. Nimmo

*Attorney, Agent, or Firm*—Herbert G. Burkard; Sheri M. Novack

[57] ABSTRACT

A heat-recoverable soldering device for soldering electrical conductors comprising a heat-recoverable sleeve and a quantity of solder is provided with a deformable retaining member which retains the conductors in the desired alignment when deformed.

12 Claims, 2 Drawing Sheets

HEAT RECOVERABLE SOLDERING DEVICE

BACKGROUND OF THE INVENTION

This invention relates to a device for forming solder connections for example electrical connections between electrical conductors, method for forming solder connections using such a device, and the manufacture thereof. In particular the invention relates to a heat-recoverable device for forming solder connections.

The use of heat-recoverable articles for forming solder connections between electrical conductors is widely used. Such articles are described for example in U.S. Pat. Nos. 3,243,211, 4,282,396 and 4,283,596, the disclosures of which are incorporated herein by reference and are sold by Raychem Corporation of Menlo Park, Calif. under the trade mark "Solder Sleeve".

Typically such a device comprises a heat-recoverable sleeve containing a solder insert, generally in the form of a ring, and may contain one or more adhesive inserts. Such devices are typically used to connect insulated wires. The ends of the wires to be joined are stripped of insulation to expose their electrical conductors and inserted into the recoverable sleeve. The sleeve is then heated, causing it to recover, or shrink, into contact with the wires and the solder to melt and solder the exposed electrical conductors. Adhesive inserts, if present, are generally located each side of the solder insert and bond to the insulation of the wires to form an environmentally sealed splice or connection.

Solder connections can be made in-line in which a tubular sleeve having two open ends is used and the wires to be connected are inserted through each end of the sleeve. It is also possible to use a tubular sleeve closed at one end and open at the other to form a stub splice in which the wires to be joined are inserted into the open end of the heat-recoverable sleeve. A solder connection can be made between a pair of wires or a complex arrangement of a plurality of wires, such as in an automotive harness.

In assembling a harness a plurality of wires are inserted into a heat-recoverable soldering device and the resulting assembly is heated, for example, by an air gun, or the assembly may be placed in an oven or positioned within a heater, for example a belt heater, such as that described in copending commonly assigned U.S. patent application Ser. No. 07/641,374 filed Jan. 15, 1991, the disclosure of which is incorporated herein by reference.

Until the device has been heated to recover the sleeve and melt the solder and then cooled, it is possible for the wires to move relative to one another and to the solder insert resulting in a relatively poor electrical connection between the wires. For example a dry joint may result or there may be incomplete bridging of the solder between the conductors. It has been proposed to include within the sleeve a heat-recoverable polymeric ring which recovers at a temperature lower than the sleeve of the device. Once this preliminary temperature has been reached, the wires are retained in position during the remainder of the heating operation. Using this approach the wires are not retained in position until the heating operation has commenced. Positioning the assembly of wires and soldering device into the heater can cause the wires to dislodge from correct alignment. There is a need to retain the wires is position as the wire assembly is moved from the location in which it is assembled into the heating element as well as through the heating and cooling operation.

SUMMARY OF THE INVENTION

One aspect of this invention comprises a device for forming a solder connection between a plurality of electrical conductors, which comprises a hollow, dimensionally heat-recoverable sleeve that contains a quantity of solder, the sleeve having at least one open end to allow insertion of one or more electrical conductors; and a deformable retaining member located within the sleeve, the retaining member being mechanically deformable to retain the conductors in the desired alignment within the sleeve.

Another aspect of this invention comprises an assembly for forming a solder connection between a plurality of electrical conductors, said assembly comprising:

a plurality of electrical conductors;

a hollow dimensionally heat-recoverable sleeve that contains a quantity of solder, the sleeve having at least one open end through which at least some of the conductors have been inserted into the sleeve;

and a deformable retaining member located within the sleeve, said retaining member having been deformed to retain the conductors in the desire alignment within the sleeve.

Yet another aspect of this invention is method of forming a solder connection between a plurality of insulated electrical wires, which comprises:

(a) stripping a length of insulation from the end of each of the wires to expose a length of the conductor;

(b) inserting the ends of the wires into the sleeve of a heat-recoverable soldering device of this invention;

(c) deforming the retaining member located with the sleeve into contact with the exposed conductor of the insulation of the wires; and (d) heating the device to recover the sleeve and to melt the solder.

DETAILED DESCRIPTION OF THE INVENTION

Figure 1:
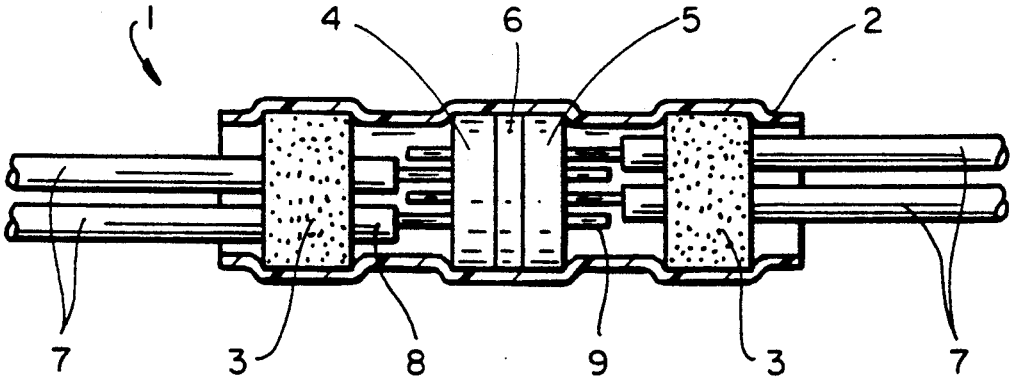
FIG. 1 illustrates a heat-recoverable soldering device of this invention and an assembly of the device and a plurality of electrical conductors to be soldered.

The device of this invention comprises a heat-recoverable sleeve. Heat-recoverable articles are well known. Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate state.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its oriniginal heat-stable shape.

Any material to which the property of dimensional recoverability may be imparted may be used to form the sleeve. Preferred materials include low, medium or high density polyethylene, ethylene copolymers, e.g. with alpha olefins such as 1-butene or 1-hexene, or vinyl acetate, screw thread. In particular it is advantageous for the wire to be formed with a polygonal, and especially a square, cross-section. The wire may be formed from any appropriate metal or metal alloy, but preferably is formed from copper, and especially from copper having substantially the same purity as that conventionally employed for electrical conductors.

The device also comprises a quantity of solder, i.e.. a quantity of soft solder as distinct from brazing material, for forming a permanent solder connection. The solder may be positioned anywhere where it will be able to flow to form a solder joint. The solder may be employed in the form of a ring or in any other form, for example a ball, and may be disposed symmetrically about the sleeve axis or offset from it.

The term "solder" as used herein includes both conventional metallic solder and solder adhesives in which a hot melt adhesive, e.g. a polyamide hot melt adhesive, or a thermosetting adhesive such as an epoxy adhesive is filled with metal particles, e.g. with silver flake. In most cases, however, the solder will be a conventional metallic solder, for example a tin/lead or tin/silver eutectic.

The deformable retaining member is preferably metallic and when deformed is in contact with the electrical conductors to be soldered. In certain embodiments of the invention, for example when the conductors to be formed are in for form of electrical wires and the insulation has been stripped from the end of each wire, the retaining member may be polymeric and be in contact with the insulation of the wires when deformed. The deformable retaining member can be made of a deformable material or can be made of a rigid material in a configuration which permits the member to attain a smaller diameter, e.g. a loaded spring.

In preferred embodiments of the invention, the retaining member is of a relatively soft metal so that it can be readily be deformed by the assembler inserting the electrical conductors into the sleeve of the device. The metal can be, for example, soft copper, lead, high temperature solder (that is solder which has a melting point higher that the soldering temperature of the solder used in the device to form the solder connection) or the like. The retention member can be circular, oval or of some other cross-sectional configuration.

The retaining member can be integral with the solder, for example it can be a strip of metal embedded in the solder. In other preferred embodiments, the retaining member is adjacent the solder, as discussed in more detail below.

The electrical conductors to be soldered are inserted into the heat-recoverable sleeve. In embodiments of the invention in which the electrical conductors are insulated wires, the insulation is removed, or stripped, from the end of each wire to expose a length of conductor. The conductors are positioned in the sleeve so that on recovery of the sleeve the solder will contact the conductors to be soldered. Once the conductors are positioned in the sleeve, the deformable retaining member is deformed to retain the conductors in the desired alignment. Preferably the amount of force used is just sufficient to mechanically retain the conductors in position. In certain embodiments, a deformable metallic retaining member may be deformed with sufficient force to crimp the conductors together to obtain an electrical connection between the conductors as well as mechanically retain them in the desired alignment within the sleeve. The assembly comprising the heat-recoverable soldering device and conductors can then be moved from the assembly location into a heater or oven. The retaining member also retains the conductors in the desires alignment during the heating operation. The retaining member may be deformed manually or a tool such as pliers or a crimping tool may be used. The retaining member can be configured so as to prevent piercing of the wall of the sleeve by the conductors during insertion of the conductors and deformation of the retaining member.

Figure 2:
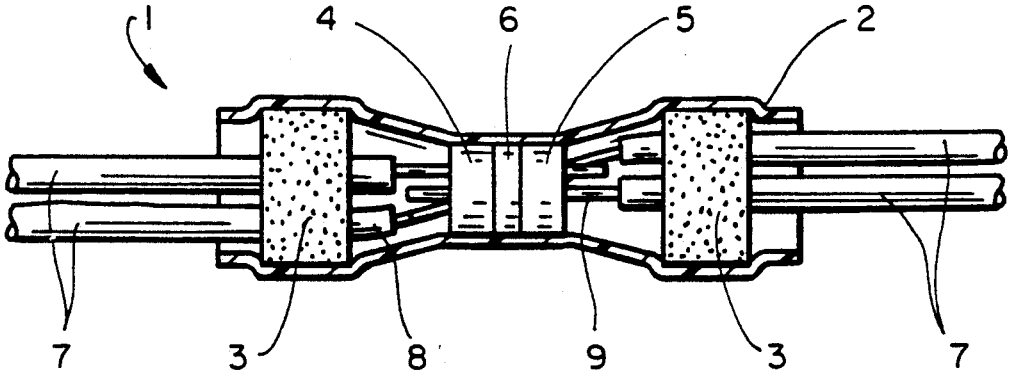
FIG. 2 illustrates the assembly of claim 1 in which the deformable retaining member has been deformed to retain the electrical conductors in position.
Figure 3:
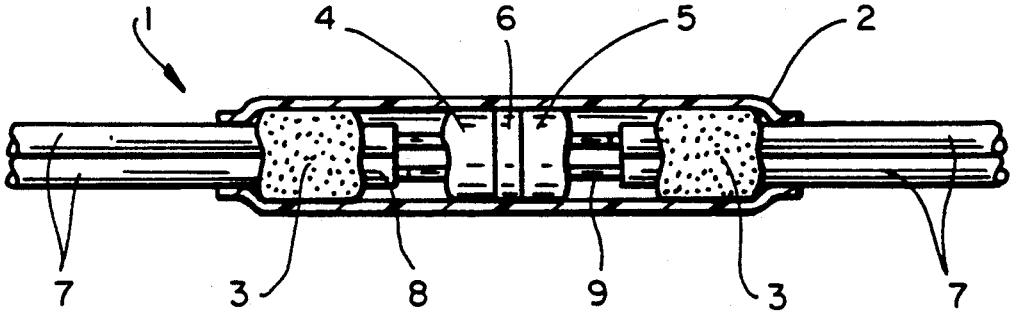
FIG. 3 illustrates a completed solder joint after heating the assembly of FIG. 2.

This invention will be more readily understood by reference to the drawings. FIG. 1. In FIG. 1, a typical device of this invention is shown generally at 1. The device includes a heat-recoverable sleeve, 2, a pair of adhesive inserts 3, solder rings 4 and 5 positioned each side of a deformable member 6 of soft copper, or similar malleable metal. Insulated wires 7, have had the insulation 8 stripped from the end of each wire to expose the electrical conductors 9. The wires are positioned in the sleeve 2 so that the exposed length of each conductor is located within the solder rings. To retain the wires in position within the sleeve, deformable member 6 can be deformed into contact with the electrical conductors as shown in FIG. 2. It is important to note that no heat has been applied and the sleeve 2 remains in its heat recoverable form in FIG. 2. The retaining member maintains the electrical conductors in position while the assembly is heated, for example by being passed through a belt heater (not shown). On application of heat, the sleeve 2 recovers into contact with wires 7 and forcing them together. The solder melts and forms an electrical connection between the exposed conductors of the wire. FIG. 3 shows the recovered sleeve.

Figure 4:
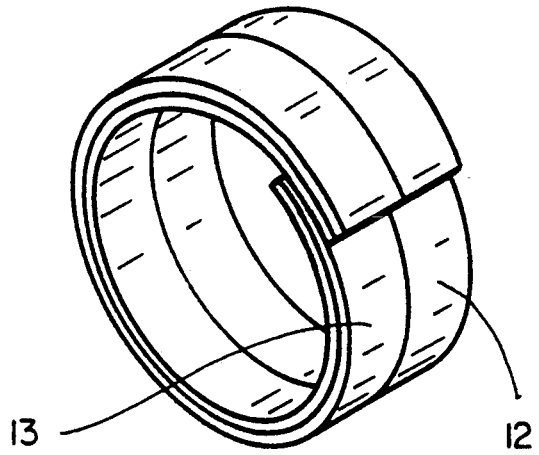
FIGS. 4 through 6 illustrate deformable retaining members for use in a device and assembly of this invention.
Figure 5:
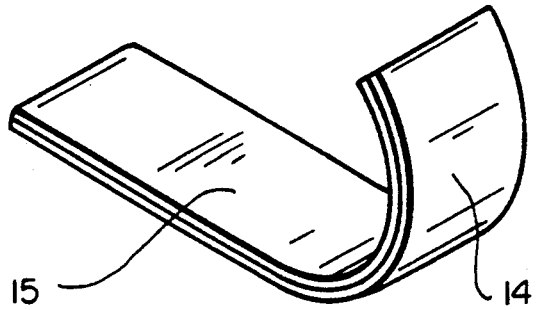
Figure 6:
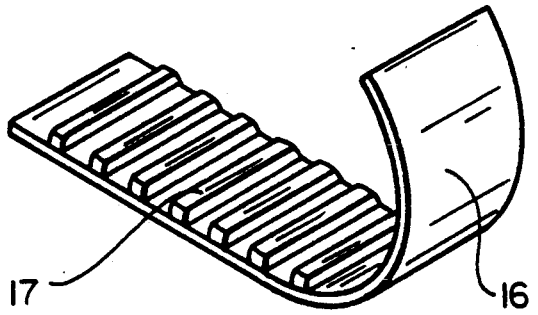

FIG. 4 shows an alternate deformable retaining member for use within a heat-recoverable soldering device in accordance with this invention. In FIG. 4, is in the form of metal strip 12 and and a strip solder 13, the composite strip being formed into a coil. Upon the application of force to the coil, the diameter of the coil will become smaller permitting the metal strip to contact and retain the electrical construction. FIG. 5 shows an alternate embodiment of a metal strip prior to being formed into a coil. In FIG. 5, metal strip 14 is provided with a layer of solder 15. FIG. 6 shows yet another embodiment of a retaining member in which metal strip 16 is provided with a discontinuous layer of solder 17 in a crenelated configuration. The strip, when coiled and placed in a heat-recoverable sleeve can be deformed into contact with the conductors and the configuration of the solder aids in retaining the conductors together. A strip of metallic mesh can also be used as the retaining member.

In each of the illustrated embodiments a relatively soft metal retaining member is deformed to retain the conductors in position within the sleeve. It is possible to utilize a hard metal not readily deformable. For example, the retaining member may be in the form of a spiral radially expanded from its stable position and held in the expanded position by, for example, a frangible, or readily breakable lip. When the lip is broken, the spiral assumes its unexpanded shape of smaller diameter which contacts the wires to retain them in position.

While this invention has been described herein in accordance with certain preferred embodiments thereof, many modifications and changes will be apparent to those skilled in the art. Accordingly it is intended by the appended claims to cover all such modifications and changes as fall within the true spirit and scope of the invention.

What is claimed is:

1. A device for forming a solder connection between a plurality of electrical conductors, which comprises
   - a hollow, dimensionally heat-recoverable sleeve that contains a quantity of solder, the sleeve having at least one open end to allow insertion of one or more electrical conductors; and
   - a deformable retaining member located within the sleeve, the retaining member being mechanically deformable to retain the conductors in the desired alignment within the sleeve, the retaining member being deformable while in contact with the conductors.

2. An assembly for forming a solder connection between a plurality of electrical conductors, said assembly comprising:
   - a plurality of electrical conductors;
   - a hollow dimensionally heat-recoverable sleeve that contains a quantity of solder, the sleeve having at least one open end through which at least some of the conductors have been inserted into the sleeve;
   - and a deformable retaining member located within the sleeve, said retaining member having been deformed while in contact with the conductors to retain the conductors in the desired alignment within the sleeve.

3. A device according to claim 2, wherein the electrical conductors are insulated, a length of insulation has been removed from the end of each conductor and the retaining member is deformable so that it contacts the exposed conductor.

4. A device according to claim 1 or claim 2 wherein the deformable retaining member is integral with said quantity of solder.

5. A device according to claim 1 or claim 2, wherein the deformable retaining member is conductive.

6. A device according to claim 1 or claim 2, wherein the deformable retaining member is metallic.

7. A device according to claim 1 or claim 2, wherein the deformable retaining member is in the form of a strip of metal.

8. A device according to claim 7, wherein the quantity of solder is a layer of solder provided with the metal strip such that the solder comes into contact with the electrical conductors when the retaining member is deformed.

9. A device according to claim 8, wherein the layer of solder is continuous.

10. A device according to claim 8, wherein the layer of solder is discontinuous.

11. A method of forming a solder connection between a plurality of insulated electrical wires, which comprises:
   - (a) providing insulated electrical wires having a conductor disposed therein;
   - (b) stripping a length of insulation from the end of each of the wires to expose a length of the conductor;
   - (c) inserting the ends of the wires into the sleeve of a heat-recoverable soldering device, wherein said device comprises:
     - (i) a hollow dimensionally heat-recoverable sleeve that contains a quantity of solder, the sleeve having at least one open end to allow insertion of one or more electrical conductors; and
     - (ii) a deformable retaining member located within the sleeve, the retaining member being mechanically deformable to retain the conductors in the desired alignment within the sleeve;
   - (d) deforming the retaining member located with the sleeve into contact with the exposed conductor of the insulation of the wires; and
   - (e) heating the device to recover the sleeve and to melt the solder.

12. A device for forming a solder connection between a plurality of electrical conductors, which comprises:
   - a hollow dimensionally heat-recoverable sleeve that contains a quantity of solder, the sleeve having at least one open end to allow insertion of one or more electrical conductors; and
   - a deformable retaining member located within the sleeve and integral with the quantity of solder, the retaining member being mechanically deformable to retain the conductors in the desired alignment within the sleeve.

* * * * *